US010982470B2

(12) United States Patent
Tametani

(10) Patent No.: US 10,982,470 B2
(45) Date of Patent: Apr. 20, 2021

(54) SELF CANCELLING LOCK MECHANISM

(71) Applicant: INTEVA PRODUCTS, LLC, Troy, MI (US)

(72) Inventor: Yoshihiko Tametani, Kanagawa (JP)

(73) Assignee: INTEVA PRODUCTS, LLC, Troy, MI (US)

( * ) Notice: Subject to any disclaimer, the term of this patent is extended or adjusted under 35 U.S.C. 154(b) by 666 days.

(21) Appl. No.: 15/684,058

(22) Filed: Aug. 23, 2017

(65) Prior Publication Data

US 2018/0058108 A1 Mar. 1, 2018

(30) Foreign Application Priority Data

Aug. 23, 2016 (JP) ..... JP2016-162435

(51) Int. Cl.
*E05B 77/20* (2014.01)
*E05C 3/14* (2006.01)

(52) U.S. Cl.
CPC ..... *E05B 77/20* (2013.01); *E05C 3/145* (2013.01); *Y10T 292/1047* (2015.04); *Y10T 292/1082* (2015.04)

(58) Field of Classification Search
None
See application file for complete search history.

(56) References Cited

U.S. PATENT DOCUMENTS 5,015,020 A * 5/1991 Mizuki ..... E05B 85/243 292/216
5,154,457 A * 10/1992 Watanabe ..... E05B 85/243 292/201
5,181,754 A * 1/1993 Shibata ..... E05B 85/243 292/216
5,531,488 A * 7/1996 Yoshikuwa ..... E05B 63/0065 292/216
5,615,564 A * 4/1997 Inoue ..... E05B 81/06 292/144

(Continued)

FOREIGN PATENT DOCUMENTS

CN 102199959 A 9/2011
CN 102747894 A 10/2012

(Continued)

OTHER PUBLICATIONS

English Translation to Japanese Office Action with English translation for Application No. 2016-162435 dated Nov. 13, 2018.

(Continued)

*Primary Examiner* — Carlos Lugo
(74) *Attorney, Agent, or Firm* — Cantor Colburn LLP

(57) ABSTRACT

A latch assembly for use with a door includes a lock lever to lock the door in a locked position and to unlock the door in an unlocked position, a door ajar cam to rotate between a door open position in response to a door open condition and a door closed position in response to a door closed condition, a self cancel lever releasably engaged to the door ajar cam, wherein the self cancel lever is operated in response to the door ajar cam rotating to the door closed position, and a lock link selectively engaged to the self cancel lever, wherein the lock link is translated to a cancelling position in response to the self cancel lever operated from the door ajar cam.

4 Claims, 3 Drawing Sheets

(56) References Cited

U.S. PATENT DOCUMENTS

| | | | | | |
|---|---|---|---|---|---|
| 5,794,992 | A * | 8/1998 | Yoneyama | E05B 81/25 | 292/216 |
| 5,833,282 | A * | 11/1998 | Ikeda | E05B 81/06 | 292/201 |
| 5,896,767 | A * | 4/1999 | Gomi | E05B 83/36 | 292/216 |
| 5,984,384 | A * | 11/1999 | Hamaguchi | E05B 85/243 | 292/216 |
| 6,305,727 | B1 * | 10/2001 | Bland | E05B 85/243 | 292/216 |
| 8,146,964 | B2 * | 4/2012 | Spurr | E05B 81/20 | 292/201 |
| 9,068,379 | B2 | 6/2015 | Yokomori et al. | | |
| 2009/0322104 | A1 | 12/2009 | Nam | | |

FOREIGN PATENT DOCUMENTS

| | | | |
|---|---|---|---|
| CN | 105026668 | A | 11/2015 |
| CN | 105464491 | A | 4/2016 |
| EP | 2369103 | A2 | 3/2017 |
| JP | H0514450 | U | 1/1993 |
| JP | H07324543 | A | 12/1995 |
| JP | 200238795 | A | 2/2002 |
| JP | 2003243738 | A | 8/2003 |

OTHER PUBLICATIONS

Japanese Office Action with English translation for Application No. 2016-162435 dated Nov. 13, 2018.

English Machine Translation to JP2002038795A Abstract.

Japanese Office Action with English translation for Application No. 2016-162435 dated Apr. 24, 218; 10 pages.

CN Office Action for Application 201710721218.X; dated May 7, 2020.

English Translation CN Office Action for Application 201710721218.X; dated May 7, 2020.

Search Report for Application 201710721218.X; dated May 7, 2020.

Chinese Office Action for Application No. CN201710721218.X; dated Dec. 10, 2020.

English Translationa to Chinese Office Action for Application No. CN201710721218.X; dated Dec. 10, 2020.

* cited by examiner

SELF CANCELLING LOCK MECHANISM

CROSS REFERENCE TO RELATED APPLICATIONS

This application claims priority under 35 U.S.C. § 119 to following Japanese Patent application no. 2016-162435, filed on Aug. 23, 2016, the entire contents of which are incorporated herein by reference thereto.

BACKGROUND

The present disclosure relates to latch assemblies, more particularly to latch assemblies for use in automobiles.

Latch assemblies for use in automobile doors may be locked and unlocked while the vehicle door is open. In such uses, a user may inadvertently lock the door of a vehicle, while in other uses the user may wish to lock the door of a vehicle without using a key.

Accordingly, it is desirable to provide a lock cancelling mechanism to prevent inadvertent locking of the latch mechanism.

BRIEF SUMMARY

According to one embodiment, a method to selectively lock a latch assembly associated with a door including opening the door, moving a lock lever to a locked position, closing the door, rotating a door ajar cam to a door closed position in response to closing the door, releasing a self cancel lever in response to the door ajar cam rotating to the door closed position, and translating a lock link to a cancelling position via the self cancel lever.

In addition to one or more of the features described above, or as an alternative, further embodiments could include that an outside release lever selectively opens the door in response to the lock lever in an unlocked position and does not open the door in response to the lock lever in the locked position.

In addition to one or more of the features described above, or as an alternative, further embodiments could include moving the lock lever to an unlocked position via the lock link translating to the cancelling position and the outside release lever is in a resting position.

In addition to one or more of the features described above, or as an alternative, further embodiments could include rotating the outside release lever to an operated position, and moving the lock lever to a retained locked position in response to the outside release lever rotating to the operated position, wherein the outside release lever is coupled to the lock lever and the lock lever in the retained locked position does not engage the lock link in the cancelling position.

According to one embodiment, a latch assembly for use with a door includes a lock lever to lock the door in a locked position and to unlock the door in an unlocked position, a door ajar cam to rotate between a door open position in response to a door open condition and a door closed position in response to a door closed condition, a self cancel lever releasably engaged to the door ajar cam, wherein the self cancel lever is released in response to the door ajar cam rotating to the door closed position, and a lock link selectively engaged to the self cancel lever, wherein the lock link is translated to a cancelling position in response to the self cancel lever released from the door ajar cam.

In addition to one or more of the features described above, or as an alternative, further embodiments could include an outside release lever to selectively open the door in response to the lock lever in the unlocked position and does not open the door in response to the lock lever in the locked position, wherein the outside release lever is coupled to the lock lever.

In addition to one or more of the features described above, or as an alternative, further embodiments could include that the lock lever is moved to the unlocked position in response to the lock link translating to the cancelling position and the outside release lever is in a resting position.

In addition to one or more of the features described above, or as an alternative, further embodiments could include that the lock lever is moved to a retained locked position in response to the outside release lever rotating to the operated position, wherein the lock lever in the retained locked position does not engage the lock link in the cancelling position.

Other aspects, features, and techniques of the embodiments will become more apparent from the following description taken in conjunction with the drawings.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Embodiments provide a latch with a self cancel lever to selectively unlock a door. The self cancel lever can prevent inadvertent locking of the latch during use.

Figure 1:
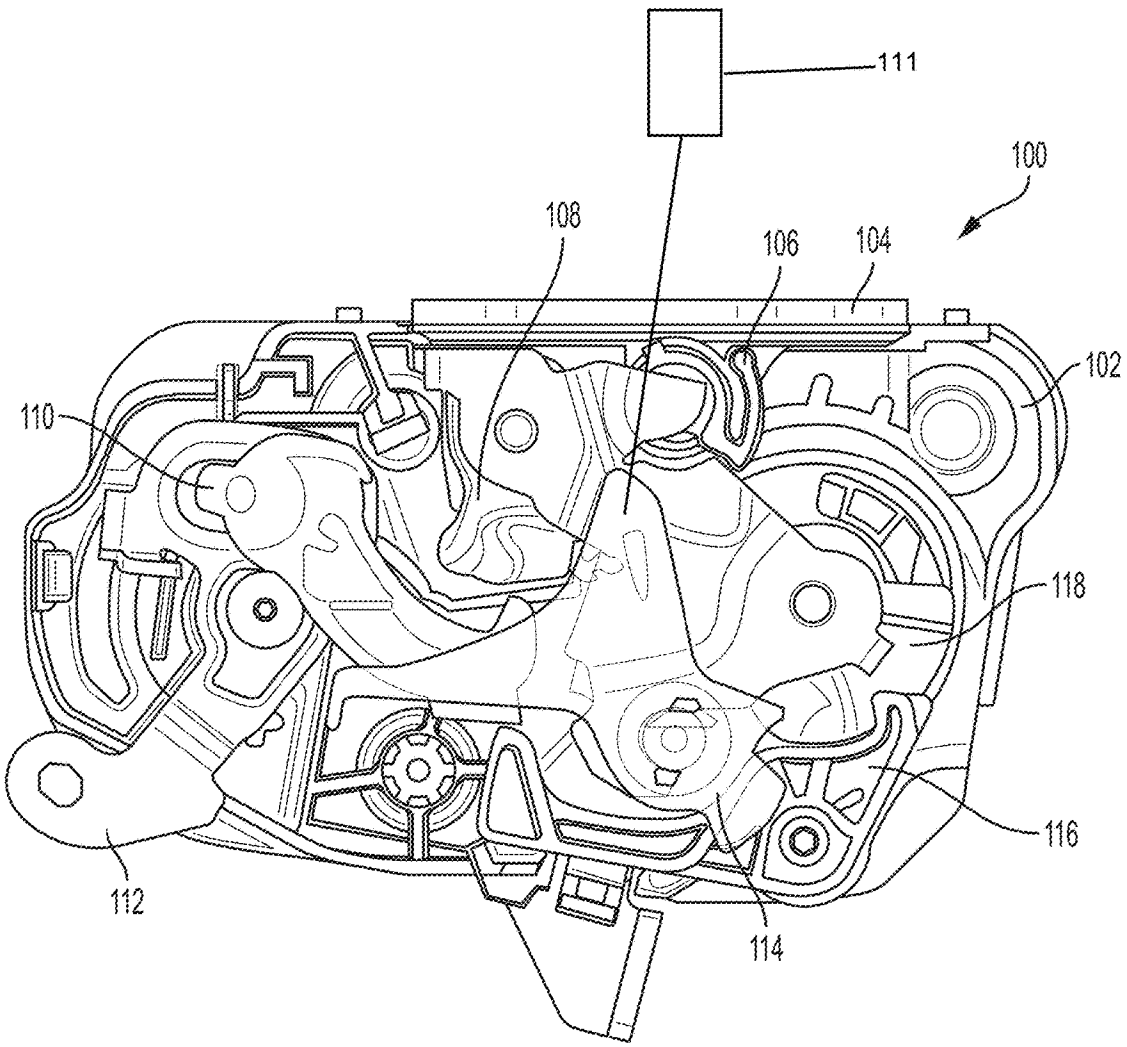
FIG. 1 is a pictorial view of a latch in accordance with this disclosure with a lock lever in a locked position.

Referring to the drawings, FIG. 1 shows a latch 100. In the illustrated embodiment, the latch 100 includes a latch housing 102, a lock lever 110, an outside release lever 112, a door ajar cam 118, a self cancel lever 116, and a lock link 114. In the illustrated embodiment, the latch 100 can be used to lock and unlock a door, such as a door of an automobile. In the illustrated embodiment, the latch 100 can be used to lock the door with the door in an open position, wherein the latch 100 can cancel the lock condition when the door is closed. Further, in certain applications, the latch 100 can be used to lock the door with the door in an open position and retain the lock condition when the door is closed. Advantageously, the latch 100 avoids inadvertently locking of the latch 100 while further allowing for keyless locking of the latch 100 as desired by the user.

In the illustrated embodiment, the latch 100 includes a latch housing 102. The latch housing 102 can house and protect the components of the latch 100. In the illustrated embodiment, the latch housing 102 can provide mounting of each of the components of the latch 100 therein. The components can be rotatably mounted to move and translate as needed. In certain embodiments, various components of the latch 100 can be disposed on top of other components, allowing for multiple layers of components therein. In the illustrated embodiment, the latch housing 102 can include a retention plate 104. In certain embodiments, the retention plate 104 can interface with a door frame or anchor point.

Figure 2:
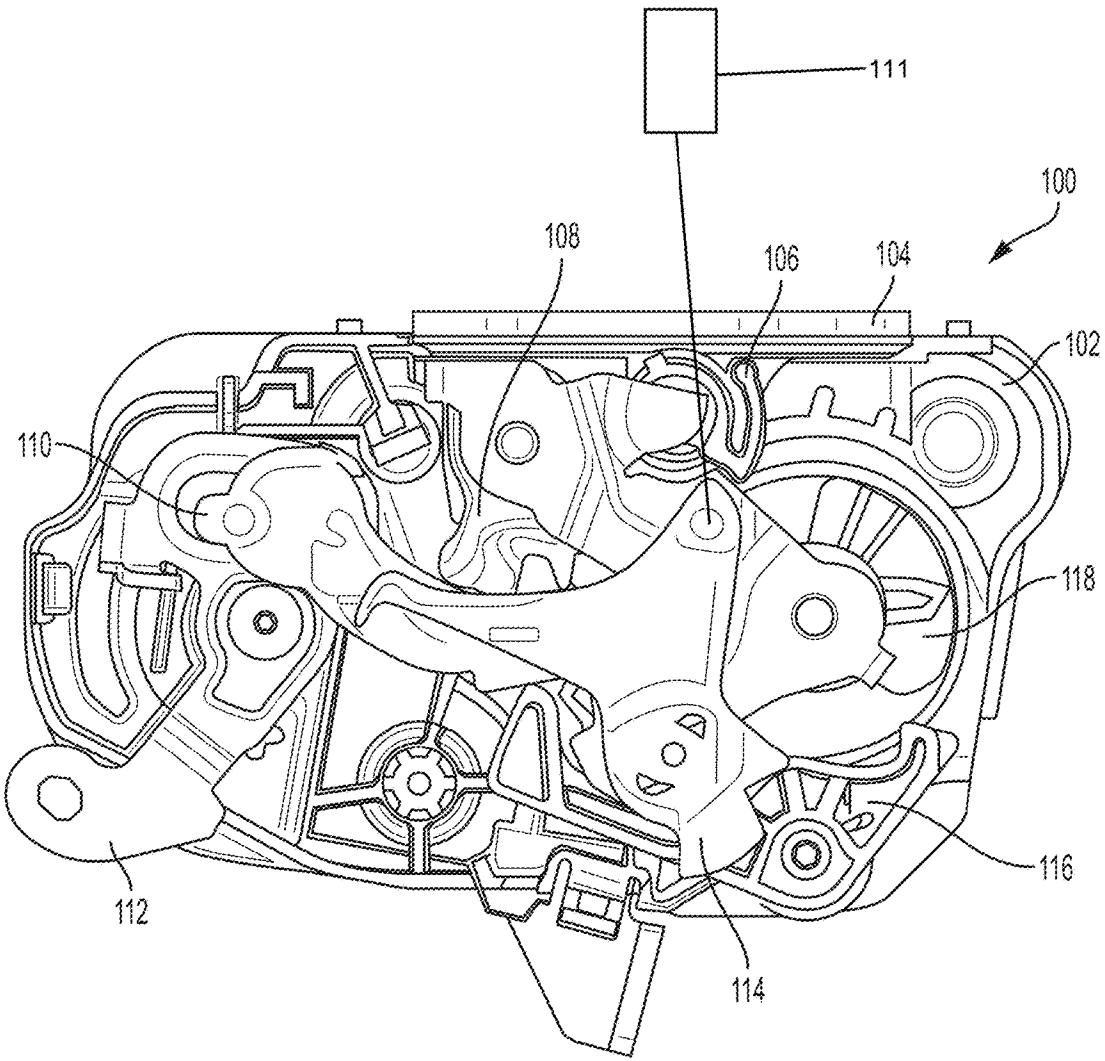
FIG. 2 is a pictorial view of the latch of FIG. 1 with the lock lever in an unlocked position.
Figure 3:
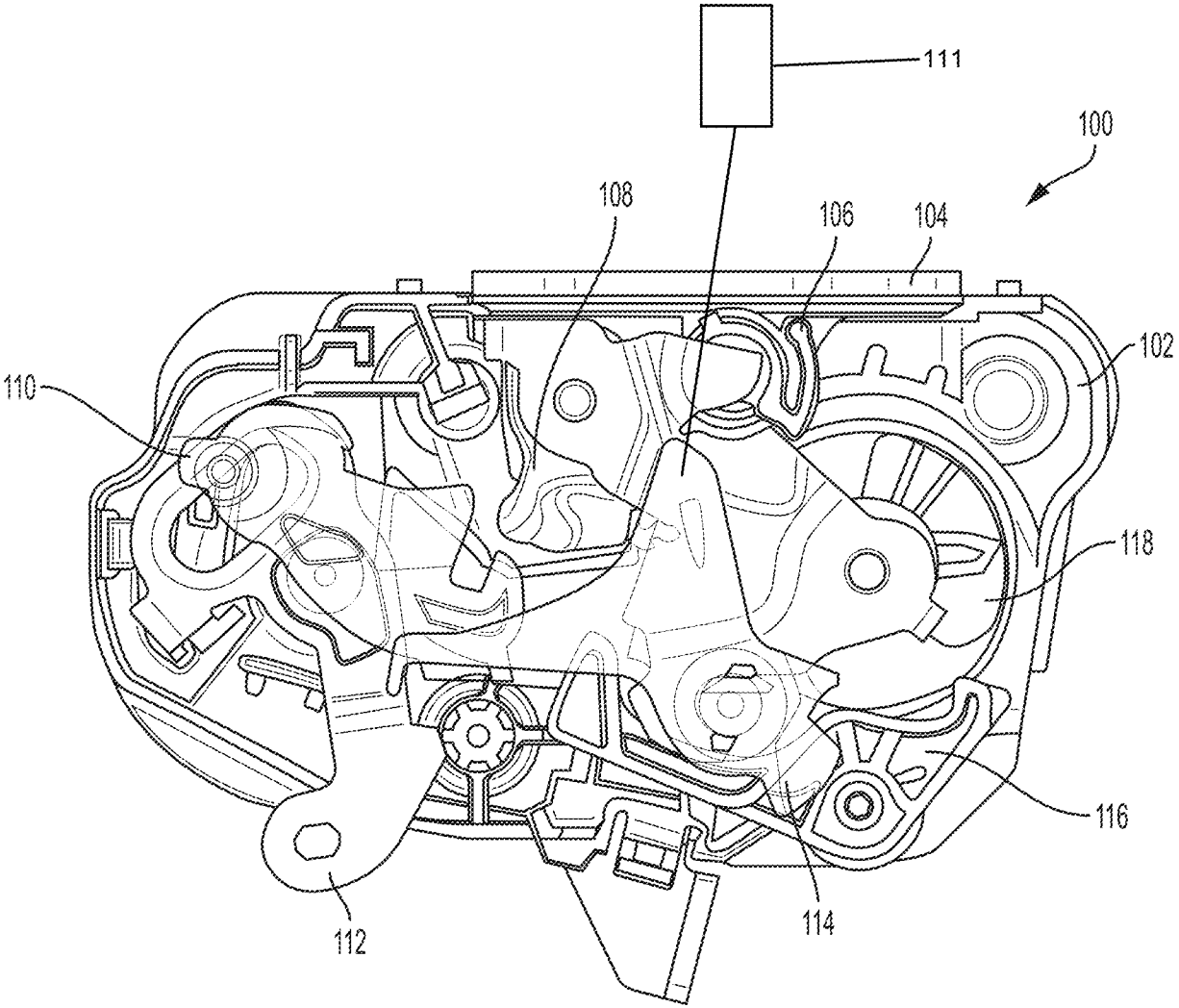
FIG. 3 is a pictorial view of the latch of FIG. 1 with an outside release lever in an operated position and the lock lever in a retained locked position.

In the illustrated embodiment, the lock lever 110 can be used to lock or unlock the latch 100 and the door associated with the latch 100. In certain embodiments, the lock lever 110 can be associated with an interior knob, toggle, etc. In certain embodiments, the lock lever 110 can be associated with an electronic actuator 111. The lock lever 110 can be disposed in a locked position (FIG. 1), an unlocked position (FIG. 2), or a retained locked position with the outside release lever 112 in an operated position (FIG. 3). In certain embodiments, the lock lever 110 can interface with a claw and pawl assembly (not shown) which may interface with a door frame to selectively open and close the door. In certain embodiments, a pawl lifter 108 can be utilized to release and engage the pawl from the claw of the claw and pawl assembly. The claw and pawl assembly can be used to engage the door frame. Referring to FIG. 1, in the illustrated embodiment, the lock lever 110 can interface with the claw and pawl assembly when the lock lever 110 is an unlocked position to selectively release the claw when desired by the user. Referring to FIG. 2, when the lock lever 110 is in a locked position, the lock lever 110 is not able to interface with the claw and pawl assembly and is therefore not able to open the door. In other embodiments, the lock lever 110 can interface with any other suitable mechanism.

In certain embodiments, the latch 100 can include an emergency lock button 106. The emergency lock button 106 can be utilized to release or engage the lock lever 110 when a conventional method of actuating the lock lever 110 is inaccessible or not functioning.

In the illustrated embodiment, the outside release lever 112 can be used to open and close the door. In the illustrated embodiment, the outside release lever 112 can be coupled to an outside handle of a door to allow a user to manipulate the outside release lever 112 from outside the vehicle. The outside release lever 112 can translate between a resting position (FIGS. 1 and 2) and an operated position (FIG. 3) when the handle is pulled. In the illustrated embodiment, the outside release lever 112 can selectively actuate the lock lever 110 to release the door from the door frame.

In the illustrated embodiment, the lock lever 110 can selectively couple the movement of the outside release lever 112 to open the door. In the illustrated embodiment, if the lock lever 110 is disposed in an unlocked position (FIG. 2), the outside release lever 112 can be pulled to the operated position to open the door. If the lock lever 110 is disposed in a locked position (FIGS. 1 and 3), the outside release lever 112 will not open the door when the outside release lever 112 is pulled to the operated position.

Referring to FIG. 3, in certain embodiments, if lock lever 110 is presently in a locked position, the outside release lever 112 can be pulled to place the lock lever 110 in a retained locked position. In the retained locked position, the lock lever 110 locked position is not affected by any adjustments to the lock condition by the lock link 114.

In the illustrated embodiment, a door ajar cam 118 can rotate in response to a door open or closed condition. The door ajar cam 118 is operatively connected to the claw, such that the door ajar cam 118 rotates together with the claw, when the claw rotates during opening and closing of the latch. In the illustrated embodiment, the door ajar cam 118 can have a door open position (FIG. 1) and a door closed position (FIGS. 2 and 3). In the illustrated embodiment, the door ajar cam 118 includes a feature to selectively retain the self cancel lever 116 when the door ajar cam 118 is in the door open position and selectively operate the self cancel lever 116 when the door ajar cam 118 is in the door closed position.

In the illustrated embodiment, the self cancel lever 116 is a spring loaded lever that can selectively manipulate the lock link 114. The self cancel lever 116 can have an operated position (FIGS. 2 and 3) and a retracted position (FIG. 1). In the illustrated embodiment, the self cancel lever 116 can be retained in the retracted position by the door ajar cam 118 in the door open position. Referring to FIGS. 2 and 3, as the door ajar cam 118 moves to a door closed position, the self cancel lever 116 can be deployed to the operated position. In the illustrated embodiment, the self cancel lever 116 in the operated position can rotate or pivot the lock link 114.

In the illustrated embodiment, the lock link 114 can selectively move the lock lever 110 from a locked position to an unlocked position. Referring to FIGS. 2 and 3, as the self cancel lever 116 is operated to an unlock position, the lock link 114 can be engaged and rotated to a cancelling position. In the illustrated embodiment, the lock link 114 in the cancelling position is rotated toward the lock lever 110.

Referring to FIG. 2, if the lock lever 110 is presently in a locked position with the outside release lever 112 in a resting position, the lock lever 110 can be moved to an unlocked position as shown in FIG. 2, when the door is opened. Advantageously, this self cancelling function can minimize users inadvertently locking the door.

Referring to FIG. 3, if the lock lever 110 is in a locked position with the outside release lever 112 in an operated position, the lock lever 110 can be placed in the retained locked position. In the illustrated embodiment, the lock link 114 will not contact the lock lever 110 while the lock link 114 is in the cancelling position because the lock lever 110 is pulled away allowing the lock lever 110 to stay in a locked condition as the door is closed. Advantageously, this can be used to provide a keyless lock function to allow the user to lock the vehicle as needed.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method to selectively lock a latch assembly associated with a door, the method comprising:

opening the door;

moving a lock lever to a locked position via a lock actuator;

closing the door;

rotating a door ajar cam operably coupled to a pawl and claw assembly to a door closed position in response to movement of the pawl and claw assembly during closing of the door;

releasing a self cancel lever operably coupled to the door ajar cam in response to the door ajar cam rotating to the door closed position, wherein the self cancel lever is a spring loaded lever that can selectively manipulate a lock link; translating the lock link to a cancelling position when the lock link is rotated toward the lock lever via the self cancel lever, wherein an outside release lever selectively opens the door in response to the lock lever in an unlocked position in which the door is unlocked and does not open the door in response to the lock lever in the locked position, and wherein in case that the lock lever is located in the locked position, when the outside release lever is rotated to an operated position, the lock lever is moved to a retained locked position, wherein the outside release lever is coupled to the lock lever and the lock lever in the retained locked position does not engage the lock link in the cancelling position.

2. The method of claim 1, wherein in case that the outside release lever is located in a resting position when the lock link is translated to the cancelling position, the lock lever is moved to an unlocked position.

3. A latch assembly for use with a door, the latch assembly comprising:

a lock lever to lock the door in a locked position and to unlock the door in an unlocked position;

an actuator for moving the lock lever to between the locked position and the unlocked position;

a door ajar cam operably coupled to a pawl and claw assembly that rotates between a door open position in response to a door open condition of the latch assembly and a door closed position in response to a door closed condition of the latch assembly;

a self cancel lever releasably engaged to the door ajar cam, wherein the self cancel lever is a spring loaded lever that is operated in response to the door ajar cam rotating to the door closed position; and a lock link selectively engaged to the self cancel lever, wherein the lock link is translated to a cancelling position in response to the self cancel lever being operated by the door ajar cam;

an outside release lever to selectively open the door in response to the lock lever in the unlocked position and the outside release lever does not open the door in response to the lock lever being in the locked position, wherein the outside release lever is coupled to the lock lever; and wherein the lock lever is moved to a retained locked position in response to the outside release lever rotating to an operated position, wherein the lock lever in the retained locked position does not engage the lock link in the cancelling position.

4. The latch assembly of claim 3, wherein the lock lever is moved to the unlocked position in response to the lock link translating to the cancelling position and the outside release lever is in a resting position.

* * * * *